United States Patent [19]

Worthy

[11] Patent Number: 4,654,973

[45] Date of Patent: Apr. 7, 1987

[54] RAILROAD TRACK GAGE

[76] Inventor: James T. Worthy, 4513 Northwood Ave., Columbus, Ga. 31907

[21] Appl. No.: 789,517

[22] Filed: Oct. 21, 1985

[51] Int. Cl.[4] ..... E01B 29/04

[52] U.S. Cl. ..... 33/144; 33/1 Q; 33/287; 33/338; 33/149 J

[58] Field of Search ..... 33/144, 1 Q, 287, 338, 33/149 J, 180 R

[56] References Cited

U.S. PATENT DOCUMENTS

| | | | |
|---|---|---|---|
| 853,126 | 5/1907 | Shires | 33/144 |
| 2,036,750 | 4/1936 | Fulbright | 33/144 |

FOREIGN PATENT DOCUMENTS

| | | | |
|---|---|---|---|
| 220182 | 3/1962 | Austria | 33/144 |
| 23837 | of 1912 | United Kingdom | 33/144 |
| 1202433 | 8/1970 | United Kingdom | 33/144 |

*Primary Examiner*—Willis Little

*Attorney, Agent, or Firm*—Michael C. Smith

[57] ABSTRACT

Apparatus for continuously monitoring the gage of a railroad track from a vehicle on said track comprising measurement means which continuously measure the distance between the rails of a railroad track and remote indication means which display data of said measurement means to a vehicle operator.

5 Claims, 3 Drawing Figures

RAILROAD TRACK GAGE

TECHNICAL FIELD

The present invention relates generally to apparatus for measuring the gage or width between railroad rails, and more specifically to an apparatus attached to the rear of a railroad inspection vehicle for continuously detecting the width between the rails.

BACKGROUND ART

It is well known in the railroad industry that there is a significant need to assure that the gage of the rails meet certain minimum and maximum requirements to assure optimum travel along the rails while preventing derailment. Several U.S. patents have issued for devices relating to this problem.

U.S. Pat. No. 325,706 shows a gage and level indicating device for railroad tracks wherein a mechanical three point rail contact apparatus is sprung against the inside of the rail to indicate gage variations on a scale. U.S. Pat. No. 3,050,015 shows track lining equiptment comprising a track alignment car having wheels on one side which cannot move outward and wheels on the other side which can move outward. U.S. Pat. No. 3,750,299 shows a laser beam reference track apparatus. U.S. Pat. No. 3,869,805 shows a track level indicator comprising a pendulum potentiometer which indicates differences in elevation between rails. U.S. Pat. No. 3,990,154 shows apparatus for measuring the distance between rails comprising a frame having rollers moveably mounted to one rail and a rail sensing roller which presses against the opposite rail to measure a distance between the rails. U.S. Pat. No. 4,027,397 shows a mobile track surveying apparatus comprising two spaced apart bogies, grade measurement means, a theodolite, and gage measurement means further comprising a pointer to indicate track gage on a scale which is located on an axle. While several of these inventions have provided means for measuring the distance between rails, there has remained a need for a simple, inexpensive, track gage measurement device adapted for mounting on one of several railroad vehicles. It is for this reason that the present railroad track gage was invented.

DISCLOSURE OF INVENTION

The present invention eliminates the need for substantial capital expense related to continuously measuring the width of railroad track rails while providing effective means therefore. This invention is a railroad track gage comprising apparatus adapted to be attached to the rear a railroad inspection vehicle or other railroad vehicle comprising a frame, a telescoping connector rod, adjustable pivot brackets, telescoping spring loaded wheel pivots, a contact board, a tension spring, a control box, and mounting brackets. Thus, a major object of the present invention is to provide apparatus for measuring the gage or width between railroad rails, said apparatus adapted to be attached to the rear of a railroad inspection vehicle or similar railroad vehicle.

BRIEF DESCRIPTION OF THE DRAWINGS

While the specification concludes with claims particularly pointing out and distinctly claiming the subject matter which is regarded as the invention, it is believed that the invention, objects, features and advantages thereof will be better understood from the following description taken in connection with the accompanied drawings in which like parts are given like identification numerals and wherein:

BEST MODE FOR CARRYING OUT THE INVENTION

Figure 1:
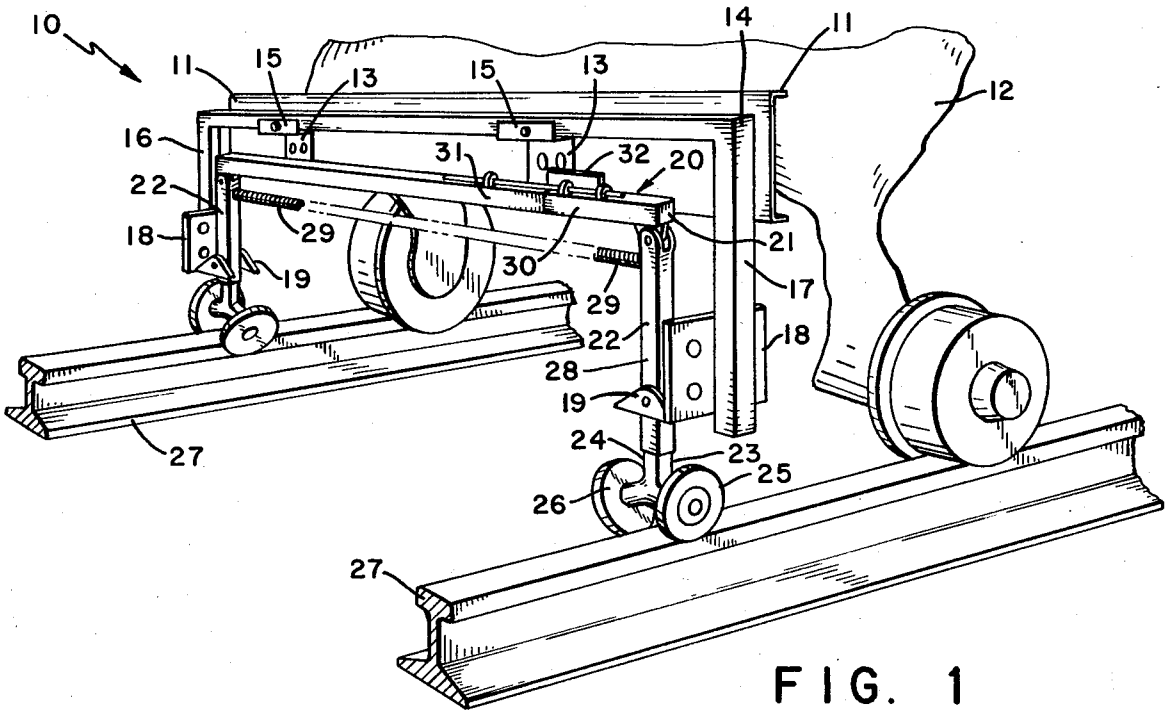
FIG. 1 is an elevation of the present invention attached to a railroad vehicle and engaged with the rails in a measuring mode.

As FIG. 1 illustrates, the present invention 10 is attached to the rear bumper 11 of a railroad vehicle 12 by brackets 13. Brackets 13 hold frame 14 in a predetermined, substantially horizontal alignment, parallel with bumper 11. Locking means 15 secure frame 14 in each bracket 13. Frame 14 comprises a left arm 16 and a right arm 17. Each arm 16, 17 has a distal vertical plate 18, to which is adjustably mounted, a yoke 19 which extends inward toward the opposite arm 16, 17. Between yokes 19 is mounted measurement means 20, which comprises a telescoping connector rod 21, and a pair of telescoping, spring loaded wheel pivots 22. One end of each wheel pivot 22 is pivotably secured to opposite ends of rod 21. Each wheel pivot 22 is also pivotably secured at about its midsection in respective yokes 19. At the end of each wheel pivot 22 furthest from rod 21 is a wheel member 23 comprising a wheel mount 24, an upper wheel 25 and an inner wheel 26. Upper wheel 25 is pressed against the top of railroad rail 27 by a compressed spring (unshown) inside the elongated portion 28 of wheel pivot 22 to assure that inner wheel 26 uniformly contacts the inner portion of the top of the rail 27. Wheel mount 24 extends inside elongated portion 28 to provide the telescoping feature which is regulated by the hidden compressed spring therein and contact of upper wheel 25 with rail 27. A tension spring 29 is secured to upper, inner surfaces of both elongated portions 28 to pull the upper portions of the wheel pivots 22 inward which causes them to pivot on yokes 19, thereby forcing the wheel members 23 outward to continously engage the respective inner surfaces of rails 27. The points of continuous engagement of inner wheels 26 equals the gage of the track. To convert the continous engagement into data of continuous measurement, connector rod 21 comprises two telescoping sections 30, 41, one slidably mounted within the other. Since the lower sections of the wheel pivots 22 have a propensity to move outward, and only move inward when forced by more inward alignment of rails 27, all gage variations are transferred to rod 21, and are detected by sensor means 32 which detect any movement of rod sections 30, 31 inward or outward.

Figure 2:
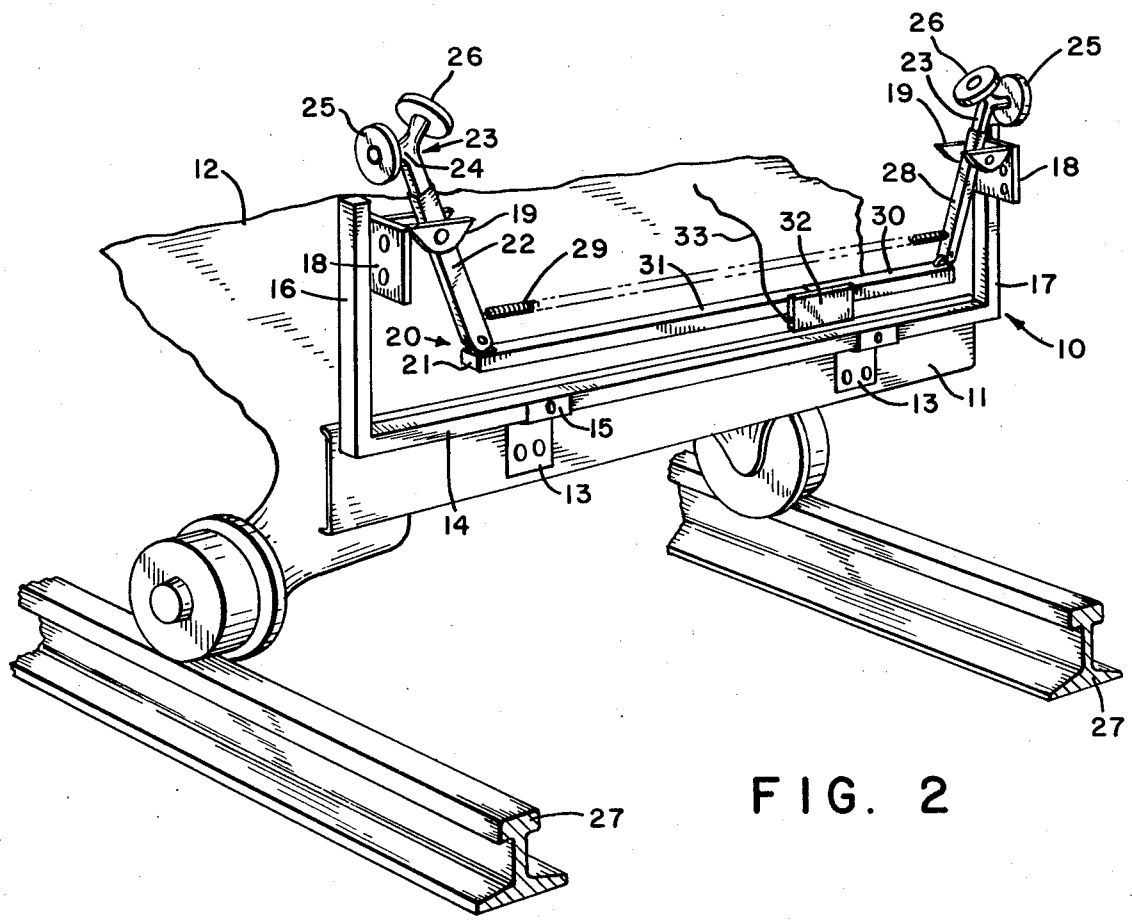
FIG. 2 is an elevation of the present invention attached to a railroad vehicle in a transportation mode.

FIG. 2 illustrates the present invention in a transportation mode, which is simply the removal of the frame 14 from the bumper 11 and reattachment in an inverted manner. This view shows the other side of the parts illustrated in FIG. 1. Note that wheel members 23 are substantially further apart because their outward movement is not limited by rails 27. One item shown more clearly in FIG. 2 is sensor means 32, at the juncture of rod member 30 and rod member 31. Attached to sensor means is a communication means 33 which will be discussed in more detail below.

Figure 3:
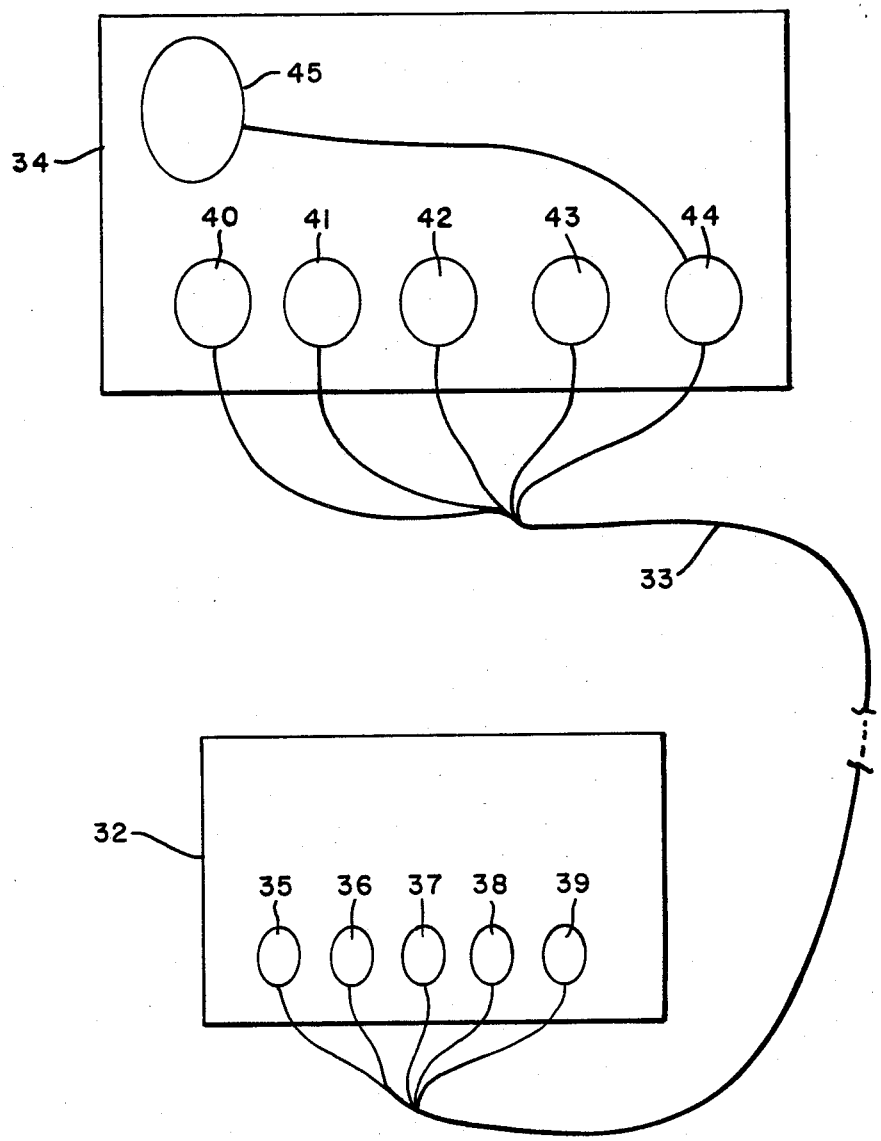
FIG. 3 is a schematic diagram of the sensor and indicator means of the present invention.

Referring to FIG. 3, it can be seen that sensor means 32 is connected by communication means 33 to a control and display station 34. Sensor 32 is located on rod 21 as previously discussed, and station 34 is located within vehicle 12 in a convenient manner to permit control and monitoring by one such as the vehicle operator. Gage irregularity typically involves over wide rails because rail traffic exerts primarily downward and outward force, rather than downward an inward force. For this reason, the present invention is concerned primarily with detection of overwide gage. Therefore, sensor means 32 comprises a series of five contact points 35, 36, 37, 38 and 39 which are sequentially engaged by movement of rod members 30, 31 together and apart. Point 35 is engaged when the ideal track gage is detected. This ideal status is often referred to as tight gage, which indicates that the distance between the rails is correct for contact with proper bearing surfaces of the wheels of a railroad vehicle. When contact is established at point 35, a signal is communicated to a tight gage indicator 40 of station 34. As the gage widens, contact moves progressively from point 35 to point 39. Each point increment indicates an appropriate increase in width such as 1/2 inch. Thus, as the width increases one increment to point 36, a signal of +1 is communicated to a +1 indicator 41 of station 34. Similarly, point 37 communicates +2 gate to +2 indicator 42, while point 38 indicated +3 at indicator 43 and point 39 indicated +4 at indicator 44. While various sensory means may be used at station 34, it is preferred that indicators 40–44 comprise various colors from blue through green, yellow, orange and red to indicate progression from normalcy to danger. In addition, as the gage increases to dangerous point 39, an audio warning 45 is activated to alarm the operator. Thus, gage is continuously monitored.

While this invention has been described in detail with particular reference to a preferred embodiment thereof, it will be understood that variations and modifications can be effective within the spirit and scope of the invention as described hereinbefore and as defined in the appended claims.

INDUSTRIAL APPLICABILITY

This invention is capable of exploitation in the railroad industry and is particularly useful in a railroad track gage monitoring system.

I claim:

1. Apparatus for continously monitoring the gage of the rails of a railroad track from a vehicle on the track comprising:

an extra-vehicular frame having two arms extending therefrom, said frame further comprising an elongated horizontal member with substantially identical vertical arms extending from each end thereof;

a distal vertical plate secured at the end of each arm;

an inward facing yoke adjustably secured to each distal plate;

measurement means pivotally mounted to said yokes, said measurement means further comprising a horizontal telescoping rod having pivotally connected to each end thereof, a vertical telescoping multiple wheel member, each wheel member being pivotally secured at about its midsection to one of said yokes, and a tension spring interconnecting portions of said wheel members near said telescoping rod and drawing said portions toward each other, further provided that said wheel members do not support the weight of said vehicle, with said wheel member further comprising an elongated portion which houses a wheel mount and a compressed spring which presses said wheel mount away from said elongated portion in a telescoping manner, said wheel mount further comprising a top wheel for contacting the top of a railroad track rail in a rolling manner and an inside wheel for contacting the inside of a railroad track rail in a rolling manner;

measurement indication means remotely connected to said measurement means; and means for securing said frame to the rear of a railroad vehicle.

2. The apparatus of claim 1 wherein said inside wheels continuously press laterally away from each other, thereby continuously contacting the inner surfaces of a pair of railroad rails.

3. The apparatus of claim 2 wherein said horizontal telescoping rod is connected to a contact plate such that movement of either telescoping portion of said rod causes change in the engagement of said contact plate.

4. The apparatus of claim 3 wherein said measurement indication means is connected by said contact plate by communication means which causes gage variations sensed by said contact plate to be indicated at said remote indication means.

5. The apparatus of claim 4 wherein said means for securing said frame to the rear of a railroad vehicle further comprises a means for attachment of the present apparatus to said vehicle in an inverted manner for transportation thereof.

* * * * *